United States Patent [19]

Tamura et al.

[11] 4,443,528

[45] Apr. 17, 1984

[54] PHOTOCONDUCTIVE MATERIALS COMPRISING NITRO OR CYANO SUBSTITUTED PHTHALOCYANINE COMPOUNDS FOR ELECTROPHOTOGRAPHY

[75] Inventors: Shinichi Tamura; Toshio Seta; Tsuneo Tanaka; Mititika Hikosaka, all of Kyobashi, Japan

[73] Assignee: Toyo Ink Manufacturing Co., Ltd., Kyobashi, Japan

[21] Appl. No.: 476,979

[22] Filed: Mar. 21, 1983

[30] Foreign Application Priority Data

Mar. 29, 1982 [JP] Japan ..... 57-49025

[51] Int. Cl.[3] ..... G03G 5/06

[52] U.S. Cl. ..... 430/56; 430/78; 430/135; 430/570; 430/66

[58] Field of Search ..... 430/78, 559, 570, 56, 430/13 S

[56] References Cited

U.S. PATENT DOCUMENTS

| | | | |
|---|---|---|---|
| 3,708,293 | 1/1973 | Brach et al. | 430/78 |
| 3,932,454 | 1/1976 | Luebbe et al. | 430/78 X |
| 4,199,509 | 4/1980 | Irvine et al. | 106/23 X |

*Primary Examiner*—John D. Welsh

*Attorney, Agent, or Firm*—Buchnam and Archer

[57] ABSTRACT

A photoconductive material comprising a phthalocyanine and a phthalocyanine derivative in which the phthalocyanine molecule has benzene nuclei substituted with at least one member selected from nitro and cyano groups, and an electrophotographic plate comprising a photoconductive layer of the photoconductive material dispersed in a binder resin.

21 Claims, 1 Drawing Figure

Figure 1:
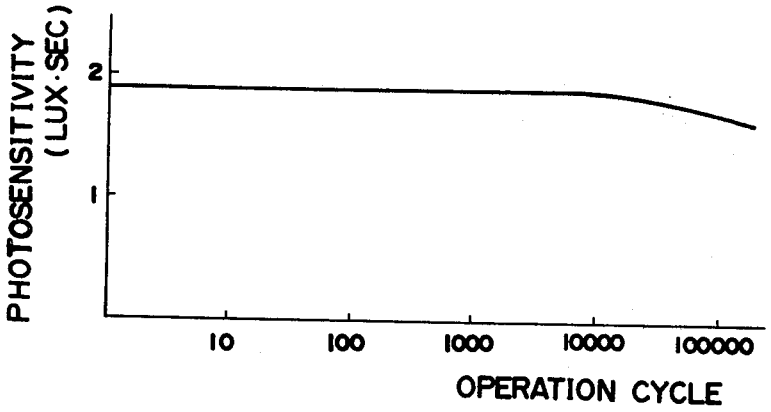

PHOTOCONDUCTIVE MATERIALS COMPRISING NITRO OR CYANO SUBSTITUTED PHTHALOCYANINE COMPOUNDS FOR ELECTROPHOTOGRAPHY

This invention relates to a photoconductive material of the type which utilizes a phthalocyanine composition comprising phthalocyanine derivatives having nitro or cyano groups at the benzene nucleus of phthalocyanine molecule. More particularly, it relates to photoconductive materials which can provide electrophotographic plates with excellent electrophotographic characteristics such as, for example, excellent photosensitivity and image stability against their repeated use without involving any hygenic problems.

Photoconductive materials find wide utility not only in the field of electrophotographic materials, but also in the fields of solar cells, materials for printing plates to be made by electrophotography, sensors and the like.

In general, electrophotography involves several methods, one of which comprises, as in xerographic system, charging in the dark a photoconductor (plate) forming a photoconductive layer comprising photoconductive material such as of selenium, cadmium sulfide or the like on a metal drum as a thin film, irradiating (exposing) the drum in a pattern of light image thereby forming an electrostatic latent image thereon, applying a toner to make a visible image (development), and transferring and fixing the visible image such as on paper. Another method comprises as in electrofax system, forming a photoconductive layer (photosensitive layer) on paper, and forming a permanent visible image on the photoconductive layer by subjecting to charging, exposure, development and fixing.

Photoconductive materials now widely used in electrophotographic plates include inorganic compounds typical of which are amorphous selenium, cadmium sulfide, zinc oxide and the like. Amorphous selenium has good characteristics as a photoconductive material but has a number of disadvantages that it is difficult to manufacture because vacuum decomposition is essential for the manufacture of photoconductive layer, and care should be taken in handling because little flexibility of vacuum deposition film and high toxicity of the material, coupled with another disadvantage that it is expensive. Cadmium sulfide and zinc oxide are used in the form of a photoconductive layer dispersing these compounds in binder resin. Since a practical level of photosensitivity is obtained only when the resin/photoconductive material ratio by weight is in the range below 0.2–0.3, mechanical properties such as flexibility, smoothness, hardness, tensile strength, abrasion resistance and the like are disadvantageously poor. This means that the photoconductive layer of the just-mentioned type cannot stand repeated use when employed as it is. Additionally, consideration should be given to cadmium sulfide with respect to hygenic problem.

On the other hand, organic photoconductive compounds which are known, include polyvinylcarbazole (PVK) and phthalocyanine.

These photoconductive layers made of the conductive materials are excellent in flexibility and processability but are not satisfactory electrophotographic sensitivity when used singly in practical applications. Accordingly, it is necessary to chemically or optically sensitize these materials. Known chemical sensitizers are, for example, polycyclic or heterocyclic nitro compounds such as 2,4,7-trinitro-9-fluorenone (TNF), 2,4,5-tetranitro-9-fluorenone (TENF) and the like, quinones such as anthraquinone, nitrile compounds such as tetracyanoethylene. Examples of optical sensitizers include xanthene dyes, quinoline dyes and the like. In this connection, however, when these sensitizers are added in amounts sufficient for electrophotographic plates to have a practical level of photosensitivity, relatively poor antistaticity and light resistance of these optical sensitizers per se present the problem that fatigue phenomena occur considerably when the electrophotographic plates are subjected to continuous charging and exposing operations. When used as a chemical sensitizer, TNF and TENF exhibit a very excellent sensitizing effect and, in fact, are often used in combination with organic photoconductors. However, these materials are expensive, so that if they are added in large amounts in order to attain a necessary level of photosensitivity, the resulting photoconductive materials will have not only a problem of cost, but also a hygenic problem on human body such as of carcinogenicity, thus leaving doubts as to the use thereof.

A method using phthalocyanine derivatives as well as phthalocyanines has been proposed. This method dictates an intense mechanical mixing process, by which phthalocyanine and phthalocyanine derivatives are uniformly mixed from which an electrophotographic photoconductive material with excellent electrophotographic characteristics can be obtained. However, the fairly long-time mechanical mixing process requires great labor, imposing a great limitation on the practice of this method from the industrial viewpoint. In addition, properties required for electrophotographic plates are not necessarily satisfied fully.

We have made extensive studies in order to overcome the drawbacks involved in the prior art. As a result, it was unexpectedly found that photoconductive materials obtained by mixing phthalocyanine derivatives in which the benzene nuclei of phthalocyanine molecule are substituted with nitro and/or cyano groups, with phthalocyanine in a relatively simple manner, exhibit excellent photosensitivity and long-term stability or without any fatigue.

By the present invention are overcome the afore-discussed drawbacks. That is, the present invention relates to photoconductive materials which comprise phthalocyanine compositions with or without the use of any chemical sensitizers which have the hygenic problem. The photoconductive materials exhibit photosensitivity comparable to cadmium sulfide plates and are held stable in sensitivity even when repeatedly used. Also they are industrially useful and involve little or no hygenic problem. As mentioned, the photoconductive material of the present invention comprises phthalocyanine and a phthalocyanine derivative in which benzene nucleus of phthalocyanine molecule has the substituents of nitro or cyano groups. In practice, the photoconductive material essentially consists of a composition which is obtained by mixing a phthalocyanine and a phthalocyanine derivative of the type mentioned above with an inorganic acid capable of forming a salt with a phthalocyanine and adding water or a base material to permit formation of a precipitation. Alternatively, the photoconductive material may be a composition which is obtained by synthesizing phthalocyanine in the presence of a phthalocyanine derivative of the above-mentioned type.

It should be noted that although there has been proposed an electrophotographic plates (Japanese Laid-open Application Gazette No. 51-95852) using therein phthalocyanine derivatives in which benzene nuclei of phthalocyanine molecule are substituted with nitro and/or cyano groups, these derivatives are merely shown as examples among a great number of derivatives. In other words, there is no particular and positive statement that phthalocyanine derivatives whose benzene nuclei are substituted with nitro and/or cyano groups can provide good electrophotographic plates. In fact, the derivatives disclosed in the examples of said Gazette are different from the derivatives of the present invention.

Phthalocyanines used in the present invention are metal-free phthalocyanines, metal-phthalocyanines and mixtures thereof. Metals of metal-phthalocyanines include, for example, copper, silver, beryllium, magnesium, calcium, zinc, cadmium, barium, mercury, aluminium, gallium, indium, lanthanum, neodymium, samarium, europium, gadolinium, dysprosium, holmium, erbium, thulium, ytterbium, lutetium, titanium, tin, hafnium, lead, thorium, vanadium, antimony, chromium, molybdenum, uranium, manganese, iron, cobalt, nickel, rhodium, palladium, osmium, platinum and the like. Alternatively, the central nucleus of phthalocyanine may not be metal atoms, but may be trivalent or higher valent metal halides. Also, phthalocyanines halogenated at low rates may be used. Of these, metal-free phthalocyanines and metal-phthalocyanines such as of copper, cobalt, lead, zinc and the like are preferable.

Phthalocyanines are compounds which are well known as pigments and phthalocyanines obtained by any preparation methods may be used in the practice of the invention. Phthalocyanines including those called "crude" in the field of pigment and finished phthalocyanines can be used. Some phthalocyanines are known to have various crystal forms such as of $\alpha$, $\beta$, $\gamma$, $\delta$, $\epsilon$, X and the like. Preferably, $\alpha$, $\beta$, $\gamma$ and $\delta$ forms are used because of ease of preparation.

Phthalocyanines of various forms can be prepared according to hitherto known techniques. For instance, copper phthalocyanine of $\alpha$ and $\gamma$ forms is prepared by a method of dissolving in sulfuric acid of high concentration and charging the solution into a large quantity of water. Copper phthalocyanine of $\beta$ form is prepared by a method in which crude copper phthalocyanine is subjected to mechanical pressure or grinding in the presence of a small amount of suitable solvent. Moreover, there are known other methods including a process of preparing copper phthalocyanine of $\epsilon$ form described in Japanese Patent Publication No. 40-2780 and Japanese Laid-open Application No. 51-95852, a process of preparing metal-free phthalocyanine of X form described in Japanese Patent Publication No. 45-8102, a process of preparing metalo- and metal-free phthalocyanine of X form described in Japanese Patent Publication No. 46-42512, and a process of copper phthalocyanine of $\gamma$ form described in Japanese Patent Publication No. 37-12836.

Phthalocyanine derivatives according to the invention are those in which the benzene nucleus of the phthalocyanine molecule is substituted with nitro or cyano groups. These phthalocyanine derivatives can be obtained by using as starting materials nitro or cyano-substituted phthalonitrile, phthalic acid, phthalic anhydride, phthalimide or some combinations thereof. The preparation of phthalocyanine derivatives are not limited to any specific techniques. The number of the substituents in one molecule of phthalocyanine derivatives is generally in the range of 1–16, preferably 1–8 and more preferably 1–4. It will be noted that the number of substituents depends on the manner of preparation and, in many cases, phthalocyanine derivatives having different numbers of substituents are obtained as a mixture.

In addition, there may be used herein phthalocyanine derivatives containing nitro and cyano groups. There may also be used photoconductive materials in which are used phthalocyanine derivatives containing at least one nitro group substituent and phthalocyanine derivatives containing at least one cyano group substituent. Further, conventional phthalocyanine derivatives other than these of this invention may still be partly used if necessary.

Phthalocyanines of phthalocyanine derivatives are, for example, metal-free phthalocyanines, metalo-phthalocyanines such as of copper, nickel, cobalt, iron, sodium, lithium, calcium, magnesium, aluminium and the like.

The mixing ratio of a phthalocyanine to a phthalocyanine derivative is in the range of 0.01–20 parts by weight of the derivative per 100 parts by weight of the phthalocyanine. Preferably, the phthalocyanine derivative is in the range of 0.1–5 parts by weight. Less amounts than 0.01 parts by weight are unfavorable because adequate photosensitivity cannot be obtained, whereas amounts exceeding 20 parts are disadvantageous in that a dark decay rate so increases as not to be suitable for practical applications.

The photoconductive material of the present invention is a substantially uniform mixture or dispersion of phthalocyanines and phthalocyanine derivatives. Accordingly, one of features of the present invention resides in that mere mixing of the materials is sufficient to obtain excellent electrophotographic characteristics. Typical mixing procedures are described below.

I. Phthalocyanine and phthalocyanine derivatives are mixed in ordinary mixing devices such as a tumbler for mixing powders.

II. Phthalocyanine and phthalocyanine derivatives are mixed in mixers along with suitable solvents such as xylene.

III. Phthalocyanine and phthalocyanine derivatives are added to binder resins and dispersed by means of ball mill, sand mill and the like devices.

IV. Dispersions of phthalocyanine or phthalocyanine derivatives in a binder regin are merely admixed with phthalocyanine derivatives or phthalocyanine.

V. Phthalocyanines and phthalocyanine derivatives are mixed with an inorganic acid capable of forming salts with the phthalocyanines, after which the resulting salts are precipitated with water or basic materials.

VI. Phthalocyanines are synthesized in the presence of phthalocyanine derivatives.

VII. Phthalocyanines are synthesized in the presence of phthalocyanine derivatives and mixed with an inorganic acid capable of forming salts with the phthalocyanines, followed by precipitation with water or basic materials.

VIII. Phthalocyanines are synthesized in coexistence with compounds capable of producing phthalocyanine derivatives thereby preparing phthalocyanine derivatives and phthalocyanines at the same time.

IX. Phthalocyanines are synthesized in coexistence with compounds capable of producing phthalocyanine derivatives to obtain phthalocyanine derivatives and phthalocyanines, which are then mixed with an inorganic acid capable of forming salts with phthalocyanines and precipitating with water or basic materials.

Accordingly, the photoconductive material of the invention is obtained by mixing or dispersing phthalocyanines and phthalocyanine derivatives by any methods I–IX, by which a substantially uniform mixture or dispersion can be obtained.

Preferable procedures of mixing or dispersion are procedures V–IX. By procedures V–IX, a uniform mixing or dispersion state is ensured with the resulting electrophotographic plate becoming excellent in electrophotographic properties.

Inorganic acids capable of forming salts with phthalocyanines and used in procedures V, VII and IX are, for example, sulfuric acid, orthophosphoric acid, pyrophosphoric acid, chlorosulfuric acid, hydrochloric acid, hydroiodic acid, hydrofluoric acid, hydrobromic acid and the like. These inorganic acids are those which are employed in known methods including acid pasting, acid slurry and the like methods for phthalocyanines. The salt formation can be effected by known techniques. For instance, phthalocyanines are dissolved in inorganic acids, followed by various methods including a method in which the solution is charged into water or the like (acid pasting method), a method in which a slurry of inorganic acid salts of phthalocyanines is obtained and charged into water or the like (acid slurry method), and a method in which inorganic acid salts of phthalocyanines are decomposed with basic materials such as ammonia gas thereby precipitating phthalocyanines.

The composition obtained by these methods has improved electrophotographic characteristics such as photosensitivity. This is considered due to uniform mixing of phthalocyanines and phthalocyanine derivatives and presence of electron-attracting groups such as nitro or cyano groups in the benzene nucleus of phthalocyanine derivatives. Accordingly, there can be obtained a photoconductive layer having practically useful electrophotographic characteristics without use of any sensitizers such as TNF. Electrophotographic characteristics of the photoconductive layer such as photosensitivity, stability of photosensitivity in repeated use and the like are at the same level as those of known photoconductive material such as cadmium sulfide with more improved light fastness.

The compositions obtained by synthesizing phthalocyanines in the presence of phthalocyanine derivatives as in procedures VI and VII are good photoconductive materials because of their uniform mixing or dispersing state.

Typical examples of preparation of phthalocyanines and phthalocyanine derivatives are described.

One of the methods is a nitrile method in which phthalodinitrile and/or nitro or cyano-substituted phthalodinitrile are heated in organic solvents such as alcohols in the presence or absence of a metal salt and a strongly basic catalyst such as alcoholate, quinoline, pyridine, 1,8-diazabicyclo(5,4,0)undecene-7 and the like. Another method comprises heating phthalic anhydride and/or nitro- and/or cyano-substituted phthalic anhydride, urea and a metal salt in the presence of a catalyst such as ammonium molybdate with or without use of solvents. Moreover, a method using aminoiminoisoindolenine is also effective.

Compositions of phthalocyanines and phthalocyanine derivatives obtained by these methods can be used as photoconductive materials for electrophotographic plate. These compositions may be used along with binder resins to form photoconductive layer or may be vacuum deposited to form photoconductive layer. Alternatively, these compositions may be coated with synthetic or natural resins or coated with monomers or prepolymers followed by polymerization to form resin film thereon, thereby giving photoconductive materials. Alternatively, the monomer or prepolymer coated on the composition may be polymerized upon formation of photoconductive layer.

The photoconductive materials obtained by these methods have substantially more satisfactory electrophotographic characteristics than materials obtained by strong mixing processes such as mechanical milling and are thus very beneficial from the industrial standpoint. Electrophotographic characteristics such as photosensitivity, stability of photosensitivity in repeated use and the like may vary depending on the kind and amount of phthalocyanine derivative but proper combinations of these materials can yield the same level of photosensitivity as known photoconductive materials such as cadmium sulfide with superior light fastness.

Phthalocyanines vary depending on the type of metal-free of metal-phthalocyanine, the type of metal, and the crystal form with respect to color sensitivity to light wavelength, photosensitivity and the like. However, the photoconductive materials of the present invention exhibit improved electrophotographic characteristics irrespective of the kind of phthalocyanine photoconductive element, making it possible to impart better electrophotographic characteristics such as photosensitivity, charge retentivity, dark decay factor, residual potential and the like than a photoconductive layer of copper phthalocyanine of $\epsilon$ form disclosed in Japanese Laid-open Application No. 51-95852. Photosensitivity, residual potential and dark decay rate give great influences on the contrast of image and operation speed in electrophotography and residual potential gives great influences on the stain of image background.

When used singly, phthalocyanines may involve the following problems though the degree or extent of problems vary depending on the type of phthalocyanine.

(1) Excellent in charging characteristic, sensitivity and the like but unsatisfactory for reduction to practice. (2) Lowering in charging potential when charging and exposure is repeated. (3) Difficult in preparing a dispersion of phthalocyanines uniformly dispersed therein, which is used in a coating step for producing a photoconductive material. (4) Difficult in stably preserving the dispersion for a time before commencement of coating of the dispersion.

These problems can be overcome according to the invention in which phthalocyanine derivatives having nitro and/or cyano groups are used in combination. In this connection, however, if the composition of the invention is not necessarily satisfactory with respect to the above problem (2), 0.01–50 parts by weight of an antioxidant may be added to the composition, by which more useful photoconductive materials can be obtained.

Less amounts than 0.01 parts by weight of an antioxidant per 100 parts by weight of a phthalocyanine photoconductive element are not advantageous since satisfactory photosensitivity may not be obtained and photosensitivity may reduce when charging and exposure is repeated with an attendant reduction of charging quantity. Amounts exceeding 50 parts by weight result in considerable deterioration of chargeability.

Most preferable antioxidants are alkylphenols such as 2,6-di-tert-butyl-4-methylphenol, 4,4'-methylene-bis(2,6-di-tert-butylphenol) and the like. Zinc dithiophosphate, metal salts of dialkyldithiocarbamic acids, 3,7-dioctylphenothiazine, aromatic amines such as 4,4'-dioctyldiphenylamine, and organic sulfides such as a reaction product of phosphorus pentasulfide and terpene may also be used.

The photoconductive material of the invention may be used along with a binder resin and the like to form a photoconductive layer, or may be used by mixing with other photoconductive materials to form a photoconductive layer. As a matter of course, ordinarily employed sensitizers may be added. Photoconductive layer may be formed by vacuum deposition.

In order to produce an electrophotographic plate using photoconductive materials of the invention, they are placed along with binder resins, solvents and the like in a kneading and dispersing machine such as a ball mill, an attritor or the like to uniformly disperse the materials. The resulting dispersion is applied onto a conductive support to form a photoconductive layer. The electrophotographic plate of the invention may comprise a photoconductive layer alone or may comprise, as superposed, a barrier layer (protective layer), an insulating layer, a carrier transfer layer and a photoconductive layer of other type of photoconductive material in addition to a photoconductive layer of photoconductive materials of the invention. Photoconductive materials of the invention are useful in making printing plate as well.

Binder resins are those which have volume resistivities over $10^8$ Ω·cm and include, for example, melamine resins, epoxy resins, silicone resins, polyurethane resins, polyester resins, alkyd resins, acrylic resins, xylene resins, vinyl chloride-vinyl acetate copolymer resins, polycarbonate resins, cellulose derivatives and the like. Polyvinylcarbazole may also be used.

The photoconductive composition of the invention is applied onto a conductive support ordinarily employed in the field of electrophotography such as, for example, an aluminium plate, or conductivity-imparted paper or plastic film thereby forming a photoconductive layer. Upon the application, a photoconductive composition may be admixed with solvent, if necessary, to control its viscosity. Applicators useful for the practice of the invention include air doctor coater, blade coater, rod coater, reverse roll coater, spray coater, hot coater, squeeze coater, gravure coater and the like. After application, the wet photoconductive layer should be suitably dried so that the layer can be imparted with adequate charging potential when charged.

The photoconductive material according to the invention has a resin/photoconductive material ratio by weight over 1, which is higher than in the case of a photoconductive material using zinc oxide. Accordingly, the photoconductive layer has high physical strength and flexibility with great adhesiveness to conductive support and good moisture proof. In addition, the layer suffers less variation in relation to time, presents no problem of toxicity, and is easy to fabricate and inexpensive.

In the foregoing, electrophotographic plates are described but the photoconductive material of the invention has utility in other fields such as of solar cells, sensors and the like.

FIG. 1 is a graph showing the relationship between the photosensitivity of an electrophotographic plate using a photoconductive material of the present invention and the photosensitivity (lux.sec.) of the plate subjected to the repeated operation of charging and exposure.

The present invention is described by way of examples, in which parts and percentage are by weight unless otherwise specified.

EXAMPLE 1

40 parts of copper phthalocyanine and 0.5 part of tetranitro copper phthalocyanine were dissolved in 500 parts of 98% concentrated sulfuric acid while agitating sufficiently. The resulting solution was charged into 5000 parts of water thereby precipitating a composition of copper phthalocyanine, tetranitro copper phthalocyanine (acid pasting). Thereafter, the composition was filtered, washed with water and dried under reduced pressure at 120° C.

One part of the composition, 3.6 parts by weight of acryl polyol (Takelac UA-702, by Takeda Chemical Industries Ltd.), 0.5 part of epoxy resin (Epon 1007, by Shell Chem. Inc.), 1.2 parts of methyl ethyl ketone and 1.2 parts of cellosolve acetate were mixed and kneaded in a porcelain ball mill for 48 hours to obtain a photoconductive composition.

The photoconductive composition was roll coated on a laminate film of a 5μ thick aluminium foil and 75μ thick polyester film so that a dry film was formed on the aluminium foil in a thickness of 8μ, followed by placing in an oven uniformly heated at 110° C. for 1 hour to give an electrophotographic plate. This sample was corona charged under conditions of +5.7 KV, a corona gap of 10 mm and a charging speed of 10 m/min. Ten seconds after stopping of the charge, the charged sample was exposed to light at an intensity of illumination of 10 lux from a 2854° K. tungsten light source. It will be noted that an amount of irradiation required to lower a potential to 50% of the potential immediately before the exposure was determined as photosensitivity. The thus measured sample was found to have a maximum surface charging amount of 580 V, a dark decay rate of 11%, a photosensitivity of 1.9 lux.sec., and a residual potential of 20 V. Thus, the chargeability and photosensitivity were enough for practical applications.

The sample was further subjected to repeated operation of charging and exposure to determine variations of an amount of charge and photosensitivity with the results shown in FIG. 1. From this, it will be seen that this sample is excellent in stability in repeated use and its photosensitivity is as high as that of a cadmium sulfide photoconductive material. The plate was positively charged and subjected to the white light exposure in a test pattern of a positive image, followed by developing with a negatively charged developing toner. As a result, there was obtained at an exposure of 2–4 lux.sec. an image which was reproduced in high fidelity according to the test pattern with clear contrast.

EXAMPLE 2

In Example 1, amounts of tetranitro copper phthalocyanine were changed at 0.1, 1 and 5 parts to determine electrophotographic characteristics in the same manner as in Example 1. As a result, it was found that although with the case using 0.1 part, the photosensitivity was 3.5 lux.sec. and with the case using 5 parts, the dark decay rate was 15%, fairly good results were obtained. The results of the case using 1 part were almost the same as those of Example 1.

EXAMPLE 3

In Example 1, 0.05 part of the following compound was further added upon kneading with the binder resin with the other conditions being the same as used in Example 1. As a result, it was found that electrophotographic characteristics were almost the same as those of Example 1 with a slight improvement of stability in repeated use.

PREPARATION OF COMPOUND

A dioxane solution of 1 mole of 2,6-di-tert-butyl-4-aminophenol (DBAP) was dropped into a dioxane solution of a mole of cyanuric chloride while cooling to below 10° C. After agitation for 1 hour, 2 moles of n-octyl alcohol were dropped at 50°-60° C., followed by agitating for 3 hours under reflux and distilling off the dioxane under reduced pressure. The resulting product was washed with water and dried to obtain a white semi-solid material.

EXAMPLE 4

40 parts of metal-free phthalochanine and 1.5 parts of mononitro copper phthalocyanine were dissolved in 1000 parts of 98% concentrated sulfuric acid while agitating sufficiently. The resulting solution was charged into 10000 parts of water to precipitate a phthalocyanine composition, followed by filtering, washing with water and drying under reduced pressure at 120° C. This composition was used to determine electrophotographic characteristics in the same manner as in Example 1 with the results of a maximum surface charging amount of 520 V, a sensitivity of 2.3 lux.sec., a dark decay rate of 10% and a residual potential of 10 V. The chargeability and photosensitivity were enough for practical applications. By a copying test, it was found that an image of clear contrast was reproduced with no stain on the background (The toner used was not attached to the image-free portion).

EXAMPLE 5

40 parts of copper phthalocyanine and 0.8 part of dinitro copper phthalocyanine were dissolved in 400 parts of chlorosulfonic acid, followed by precipitating a composition with 2000 parts of ice. The composition was treated in the same manner as in Example 1 to determine electrophotographic characteristics, with the results of a maximum surface charging amount of 550 V, a dark decay rate of 9%, a photosensitivity of 2.1 lux.sec. and a residual potential of 10 V. These values were sufficient for practical applications. By a copying test, there was obtained an image of clear contrast without involving any stain in the background.

COMPARATIVE EXAMPLE 1

One part of copper-phthalocyanine of α form obtained by the acid pasting described in Example 1 using copper phthalocyanine alone, and 0.01 part of TNF were treated in the same manner as in Example 1 to obtain a photoconductive composition. This composition was used to give an electrophotographic plate, which was subjected to the measurement of electrophotographic characteristics. The results demonstrate a maximum surface charging amount of 80 V, a dark decay rate of 60% and a photosensitivity of 20 lux.sec. which are not satisfactory for practical applications.

COMPARATIVE EXAMPLE 2

40 parts of copper phthalocyanine were dissolved in 1000 parts of 98% concentrated sulfuric acid. The resulting solution was charged into 10000 parts of water, followed by treating in the same manner as in Example 1 to determine electrophotographic characteristics. The results demonstrate a maximum surface charging amount of 220 V, a dark decay rate of 40%, a photosensitivity of 41 lux.sec. and a residual potential of 60 V, which were not satisfactory for practical applications.

EXAMPLE 6

| | |
|---|---|
| Copper phthalocyanine of β form (Lionol Blue SL, by Toyo Ink Mfg. Co., Ltd.) | 1 part |
| Trinitro copper phthalocyanine | 0.01 part |

The above composition was mixed in a powder mixer (tumbler) sufficiently. Then, this mixture was placed in a porcelain ball mill along with the following composition and kneaded for 48 hours to obtain a photoconductive composition.

| | |
|---|---|
| Acryl polyol (Takelac UA-702, by Takeda Chemical Industries Ltd.) | 3.6 parts |
| Epoxy resin (Epon 1007, by Shell Chem. Inc.) | 0.5 part |
| Methyl ethyl ketone | 1.2 parts |
| Cellosolve acetate | 1.2 parts |

This photoconductive composition was subjected to the measurement of electrophotographic characteristics in the same manner as in Example 1, with the results of a maximum surface charging amount of 550 V, a dark decay rate of 10%, a photosensitivity of 3.6 lux.sec. and a residual potential of 18 V. Thus, the chargeability and photosensitivity were enough for practical applications. The sample was further subjected to the repeated operation of charging and exposure to measure a variation of photosensitivity similar to that of FIG. 1. Thus, the photosensitivity in repeated use was excellent and comparable to a photosensitivity of a cadmium sulfide photoconductive material. The plate of this example was positively charged, subjected to white exposure in a test pattern of a positive image, and developed with a negatively charged developing toner. As a result, there was obtained at an exposure of 2-4 lux.sec., an image of clear contrast which was reproduced in high fidelity according to the test pattern.

| | |
|---|---|
| Copper phthalocyanine of α form | 10 parts |
| Tetracyano copper phthalocyanine | 0.2 part |
| 2,2-methylenebis(4-ethyl-6-tert-butylphenol) | 0.5 part |
| Polyester resin (Vylon-200, by Toyobo Co., Ltd.) | 50 parts |
| Tetrahydrofuran | 20 parts |
| Toluene | 20 parts |

EXAMPLE 7

The above composition was kneaded in a ball mill for 48 hours. The resulting photoconductive composition was applied in the same manner as in Example 1 to form a photoconductive layer on the aluminium of the laminate thereby obtaining a plate. This material had a maximum surface charging amount of 500 V, a dark decay rate of 12%, a photosensitivity of 4.0 lux.sec., and a residual potential of 15 V. Thus, the chargeability and photosensitivity were enough for practical applications. After repeating the charging and exposure operation 10000 times, it had a maximum surface charging amount of 480 V and a photosensitivity of 3.8 lux.sec. and was thus excellent as a plate.

EXAMPLE 8

In Example 7, copper phthalocyanine of α form, tetracyano copper phthalocyanine, tetrahydrofuran and toluene were mixed in a ball mill for 30 minutes. Thereafter, the other ingredients of Example 7 were added to the mixture and kneaded for 48 hours. The resulting photoconductive composition was treated in the same manner as in Example 7 to obtain a plate. This plate exhibited excellent characteristics similar to those of Example 7.

EXAMPLE 9

In the same manner as in Example 6 using copper phthalocyanine of β form instead of copper phthalocyanine of ε form in Example 6 and tetranitro copper phthalocyanine instead of trinitro copper phthalocyanine, electrophotographic characteristics were measured, with the results of a maximum surface charging amount of 500 V, a dark decay rate of 15%, a photosensitivity of 3.0 lux.sec. and a residual potential of 10 V.

COMPARATIVE EXAMPLES 3–5

The general procedure of Example 6 was repeated using, instead of trinitro copper phthalocyanine, copper phthalocyanine derivatives indicated in Table 1 below thereby determining electrophotographic characteristics. The results are shown in Table 2.

TABLE 1

| | Copper phthalocyanine Derivatives |
|---|---|
| Comparative Example 3 | 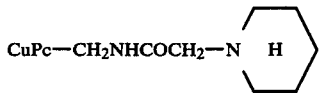 |
| Comparative Example 4 | $CuPc—(SO_3H)_3$ |
| Comparative Example 5 | 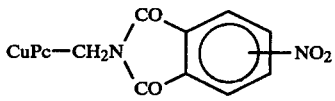 |

(CuP represents a residue of copper phthalocyanine.)

COMPARATIVE EXAMPLE 6

The general procedure of Example 9 was repeated without use of tetranitro copper phthalocyanine thereby determining electrophotographic characteristics. The results are shown in Table 2.

EXAMPLE 10

2.4 parts of 4-nitrophthalimide, 34 parts of phthalic anhydride, 60 parts of urea, 5.8 parts of cuprous chloride and 0.1 part of ammonium molybdate were heated under agitation in 200 parts of trichlorobenzene at a reaction temperature of 180° C. for 15 hours. The content was filtered, washed sufficiently with methanol and boiled in 1000 parts of an aqueous 3% sodium hydroxide solution for 2 hours, followed by filtering under heating conditions. The resulting product was washed with water in a sufficient amount until the filtrate became neutral and then washed with 1000 parts of an aqueous 1% hydrochloric acid solution, followed by drying under a vacuum of $10^{-3}$ mmHg at 130° C. The resulting blue compound was further washed with dioxane by the use of Soxhlet's extractor. Thus, 30.5 parts of copper phthalocyanine compound was obtained and found to have crystals of α form when determined by an X-ray diffraction device.

This composition was used to make an electrophotographic material in the same manner as in Example 1 for determination of electrophotographic characteristics, with the results of a maximum surface charging amount of 530 V, a dark decay rate of 15%, a photosensitivity of 2.2 lux.sec., and a residual potential of 25 V. Thus, the chargeability and photosensitivity were enough for practical applications.

EXAMPLE 11

One part of tetranitro copper phthalocyanine, 68 parts of phthalic anhydride, 120 parts of urea, 11.6 parts of cuprous chloride and 0.2 parts of ammonium molybdate were charged into a four-neck distillation flask along with 400 parts of trichlorobenzene and heated at 180° C. for 15 hours while agitating. The resulting crude product was sufficiently washed with methanol and filtered. The product was boiled in 2000 parts of an aqueous 3% sodium hydroxide solution for 2 hours, filtered and washed sufficiently with water, followed by boiling in 2000 parts of an aqueous 1% hydrochloric acid solution, filtering and washing with water. The resulting blue compound was washed in dioxane solvent using Soxhlet's extractor. 70 parts of the thus obtained copper phthalocyanine composition had α crystal form when analyzed by X-ray diffraction.

Thereafter, 10 parts of the composition and 30 parts of an aqueous alkaline solution of 10% rosin were charged into 1000 parts of water and agitated by a high speed mixer. Moreover, an 10 parts of an aqueous 5% calcium chloride solution was added under agitation, followed by filtering, sufficiently washing with water and drying.

The resulting composition was used to determine electrophotographic characteristics in the same manner as in Example 1, with the results of a maximum surface charging amount of 490 V, a dark decay rate of 10%, a photosensitivity of 2.6 lux.sec., and a residual potential of 25 V. Thus, the chargeability and photosensitivity were enough for practical applications.

EXAMPLE 12

40 parts of copper phthalocyanine and 0.5 part of tetracyano cobalt phthalocyanine were dispersed in 200 parts of glacial acetic acid, into which was 10 parts of 98% sulfuric acid while agitating. After further agitation for 10 hours, the solid matters were separated by filtration, through which ammonia gas was passed to precipitate a phthalocyanine composition, followed by washing with water and drying under reduced pressure at 120° C. The composition was subjected to the measurement of electrophotographic characteristics and also to the copying test in the same manner as in Example 1. As a result, it was found that the photoconductive material had a maximum surface charging amount of 520 V, a dark decay rate of 8%, a photosensitivity of 3 lux.sec. and a residual potential of 20 V, which were enough for practical applications. Furthermore, the copied paper had an image of clear contrast without involving no stain on the background thereof.

EXAMPLE 13

A mixture of one part of the composition obtained in Example 1 by the acid pasting method, 10 parts of polycarbonate resin (Panlite K-1300, Teijin Chem. Co., Ltd.) and 80 parts of tetrahydrofuran were kneaded in a porcelain ball mill for 48 hours to obtain a photoconductive composition. This composition was used to determine electrophotographic characteristics in the same manner as in Example 1. The results are shown in Table 2. A copied matter had clear contrast similar to the case of Example 1.

EXAMPLE 14

The photoconductive composition obtained in Example 1 was roll coated on a laminate film of a 5μ thick aluminium foil and a 75μ thick polyester film so that a dry thickness on the aluminium foil was 8μ, followed by placing in an oven uniformly heated at 110° C. for 1 hour. Then, a coating solution of the following composition was overcoated on the layer by means of a bar coater so that a dry thickness was 1μ, followed by drying in the same manner as mentioned above to obtain an electrophotographic plate.

Overcoating Composition

| | |
|---|---|
| Acryl polyol (Takelac UA-702, Takeda Chemical Industries Ltd.) | 3.6 parts |
| Epoxy resin (Epon 1007, Shell Chem. Inc.) | 0.5 part |
| Methyl ethyl ketone | 1.2 parts |
| Cellosolve acetate | 1.2 parts |

Electrophotographic characteristics were measured in the same manner as in Example 1 with the results shown in Table 2. This plate had satisfactory chargeability and photosensitivity for practical applications. Further, this sample was placed in an ozone generator and then subjected to the repeated operation of charging and exposure, with the result that no change in chargeability and photosensitivity was observed and thus the sample was very stable.

The samples obtained in Examples 4–14 and Comparative Examples 1–6 were, as described hereinbefore, subjected to the repeated operation of charging and exposure to measure their variations of charging amount and photosensitivity. The results are shown in Table 2. From the Table, it will be apparent that the samples of Examples 4–14 are superior in stability in repeated use to those of Comparative Examples 1–5. The samples of Comparative Examples 1–5 were inferior in initial characteristic values and deteriorated by several times repetitions to such an extent that the measurements could not be effected. With respect to the sample of Comparative Example 6, its photosensitivity was inferior to those of Examples.

TABLE 2

| Examples & Comparative Examples | Initial Values | | Values after 1000 Operation Cycles | | Values after 5000 Operation Cycles | |
|---|---|---|---|---|---|---|
| | Charging Amount | Photosensitivity | Charging Amount | Photosensitivity | Charging Amount | Photosensitivity |
| Example 4 | 520 | 2.3 | 520 | 2.3 | 510 | 2.1 |
| Example 5 | 550 | 2.1 | 550 | 2.1 | 540 | 2.0 |
| Example 6 | 550 | 3.6 | 550 | 3.5 | 530 | 3.3 |
| Example 7 | 500 | 4.0 | 500 | 4.0 | 500 | 3.9 |
| Example 8 | 510 | 4.0 | 510 | 4.0 | 500 | 3.9 |
| Example 9 | 500 | 3.0 | 490 | 3.0 | 480 | 2.9 |
| Example 10 | 530 | 2.2 | 520 | 2.2 | 510 | 2.0 |
| Example 11 | 490 | 2.6 | 480 | 2.6 | 460 | 2.5 |
| Example 12 | 520 | 3.0 | 520 | 3.0 | 510 | 2.8 |
| Example 13 | 500 | 2.8 | 500 | 2.8 | 480 | 2.6 |
| Example 14 | 490 | 2.9 | 490 | 2.9 | 470 | 2.6 |
| Com. Ex. 1 | 80 | 20.0 | — | — | — | — |
| Com. Ex. 2 | 220 | 41.0 | — | — | — | — |
| Com. Ex. 3 | 480 | 45.0 | — | — | — | — |
| Com. Ex. 4 | 70 | 40.0 | — | — | — | — |
| Com. Ex. 5 | 450 | 20.0 | — | — | — | — |
| Com. Ex. 6 | 520 | 10.0 | 510 | 9.5 | 490 | 9.0 |

What is claimed is:

1. A photoconductive material comprising a phthalocyanine and a phthalocyanine derivative in which the phthalocyanine molecule has benzene nuclei substituted with at least one member selected from nitro groups and cyano groups.

2. A photoconductive material according to claim 1, wherein said phthalocyanine has a crystal form selected from the group consisting of α and β forms.

3. A photoconductive material according to claim 1 or 2, wherein said phthalocyanine derivative has 1–8 members selected from nitro and cyano substituents in the phthalocyanine molecule.

4. A photoconductive material according to claim 3, wherein said material comprises 100 parts by weight of the phthalocyanine and 0.1–20 parts by weight of the phthalocyanine derivative.

5. An electrophotographic plate comprising a photoconductive layer of the photoconductive material of claim 4 dispersed in a binder resin.

6. An electrophotographic plate according to claim 5, wherein no ordinary chemical sensitizer is contained.

7. An electrophotographic plates according to claim 6, further comprising an antioxidant.

8. A photoconductive material comprises a composition obtained by mixing a phthalocyanine and a phthalocyanine derivative with an inorganic acid capable of forming a salt with the phthalocyanine, and precipitating the mixture with water or an basic material.

9. A photoconductive material according to claim 8, wherein said phthalocyanine is copper phthalocyanine.

10. A photoconductive material according to claim 8, wherein said phthalocyanine is metal-free phthalocyanine.

11. A photoconductive material according to any one of claims 8, 9 or 10, wherein the phthalocyanine of said phthalocyanine derivative is copper phthalocyanine.

12. A photoconductive material according to any one of claims 8, 9 or 10, wherein said phthalocyanine derivative has 1–8 members selected from nitro and cyano substituents in the phthalocyanine molecule.

13. A photoconductive material according to any one of claims 8, 9 or 10, wherein said material comprises 100 parts by weight of the phthalocyanine and 0.01–20 parts by weight of the phthalocyanine derivative.

14. An electrophotographic plate comprising a photoconductive layer of the photoconductive material of claim 13 dispersed in a binder resin.

15. An electrophotographic plate according to claim 14, wherein no ordinary chemical sensitizer is contained.

16. An electrophotographic plate according to claim 15, further comprising an antioxidant.

17. An electrophotographic plate according to claim 14, wherein said photoconductive layer has a protective layer formed thereon.

18. A photoconductive material comprising a composition obtained by synthesizing a phthalocyanine in the presence of a phthalocyanine derivative.

19. A photoconductive material according to claim 18, wherein said phthalocyanine derivative has 1–8 members selected from nitro and cyano substituents in the phthalocyanine molecule.

20. A photoconductive material according to claim 18 or 19, wherein said material comprises 100 parts by weight of a phthalocyanine and 0.1–20 parts by weight of a phthalocyanine derivative.

21. An electrophotographic plate comprising a photoconductive layer of the photoconductive material of claim 20 dispersed in a binder resin.

* * * * *